US010647499B1

(12) United States Patent
Cooney

(10) Patent No.: US 10,647,499 B1
(45) Date of Patent: May 12, 2020

(54) CONTAINER FOR PROJECTING EATABLES FOR EASY REMOVAL

(71) Applicant: Vernon Cooney, Safety Harbor, FL (US)

(72) Inventor: Vernon Cooney, Safety Harbor, FL (US)

( * ) Notice: Subject to any disclaimer, the term of this patent is extended or adjusted under 35 U.S.C. 154(b) by 0 days.

(21) Appl. No.: 16/268,675

(22) Filed: Feb. 6, 2019

(51) Int. Cl.
*B65D 83/00* (2006.01)
*A47G 19/30* (2006.01)

(52) U.S. Cl.
CPC ..... *B65D 83/0011* (2013.01); *A47G 19/30* (2013.01)

(58) Field of Classification Search
CPC ..... A45D 49/04
USPC ..... 401/175; 73/429
See application file for complete search history.

(56) References Cited

U.S. PATENT DOCUMENTS 16,392 A 1/1857 Mendenhall
321,478 A 7/1885 Benton
6,409,403 B1 * 6/2002 Woos ..... A45D 40/023 220/836
6,932,530 B1 * 8/2005 Bissel ..... B65D 83/0011 401/11
9,084,499 B2 * 7/2015 Papavero ..... A47G 19/18
2009/0317165 A1 * 12/2009 Wangler ..... A47G 19/303 401/12

* cited by examiner

*Primary Examiner* — David P Angwin
*Assistant Examiner* — Joshua R Wiljanen

(57) ABSTRACT

A container that facilitates projecting out eatables for their easy removal is disclosed. The container includes an outer casing, a rotatable handle, a shaft, a movable platform and a cap. The outer casing has a base portion and a housing portion, which are partitioned by a partition. The base portion is defined with a cavity in which handle fits. The shaft is defined with a lower part and an upper part. The lower part is threaded and connected with rotatable handle. Rotation of rotatable handle causes rotation of shaft. Rotation of shaft enables lifting of movable platform, which lifts eatables. Lifting of eatables causes projection of eatables outside the outer casing thus facilitating easy removal. These eatables can be butter, cheese, mayonnaise, chocolate, jams and jelly and like other creamy and solid-solid textures.

14 Claims, 4 Drawing Sheets

CONTAINER FOR PROJECTING EATABLES FOR EASY REMOVAL

BACKGROUND OF THE INVENTION

1. Field of the Invention

The present disclosure relates to a food container. More particularly, the present disclosure relates to a container for projecting eatables for easy removal.

2. Description of the Related Art

Food items such as butter, cheese, mayonnaise, chocolate, jams and jelly are difficult to remove because of their creamy or semi-solid texture. Hence, there is a need for a container that project out such food items/eatable.

Several designs for various food containers have been designed in the past. None of them, however, includes a container for eatables that projects out eatables for their easy removal.

Applicant believes that a related reference corresponds to a U.S. Pat. No. 8,079,499 filed by JUTEAU DAVID for a dispensing jar for viscous food product. The Davis patent discloses a food product jar that facilitates dispensing the product, even when the contents are mostly depleted. However, food product jar has a number of components such as channels, lips that makes the jar complex and requires a thread post running substantially along the length.

Another related application is US patent application number 20050016392 by CVC FINANCIAL LP. For a disposable butter container. The patent application '392 discloses a disposable butter dispenser that dispenses a spreadable product by rotating a base screw to revolve a piston supporting a spreadable product, the revolving piston traveling both longitudinally and axially so as to shave off spreadable product through holes in the dispenser's housing. However, the container has a number of components such as base adaptor, base screw, washer and piston that are complex in structure.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a container that facilitates projecting out eatables for their easy removal.

It is another object of the present invention to provide a container for eatables that easily removes eatables without any mess and eliminates wastage.

It is still another object of the present invention to provide a container for eatables that include a shaft having a lower part and upper part and the lower part is threaded and rotated by a rotatable handle to allow movable platform to project out eatables.

It is still another object of the present invention to provide a container that projects out eatables such as butter, cheese, mayonnaise, chocolate, jams and jelly and like other creamy and solid-solid texture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
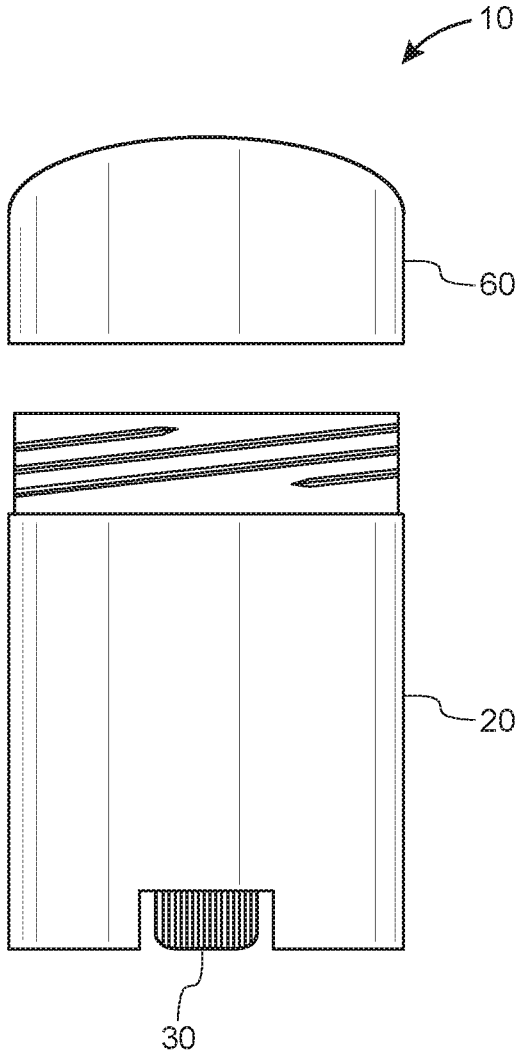
FIG. 1 represents a schematic representation of a container 10 for eatables provided with an outer casing 20 and cap 60.
Figure 2:
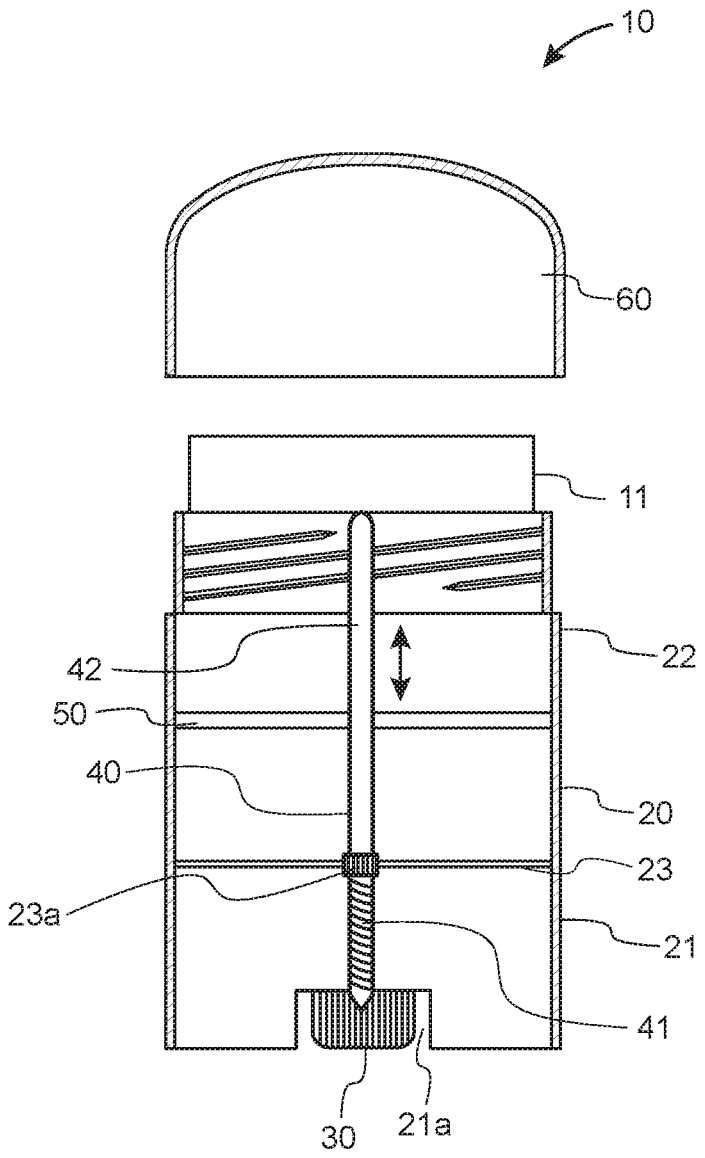
FIG. 2 represents an internal view of container 10.
Figure 3:
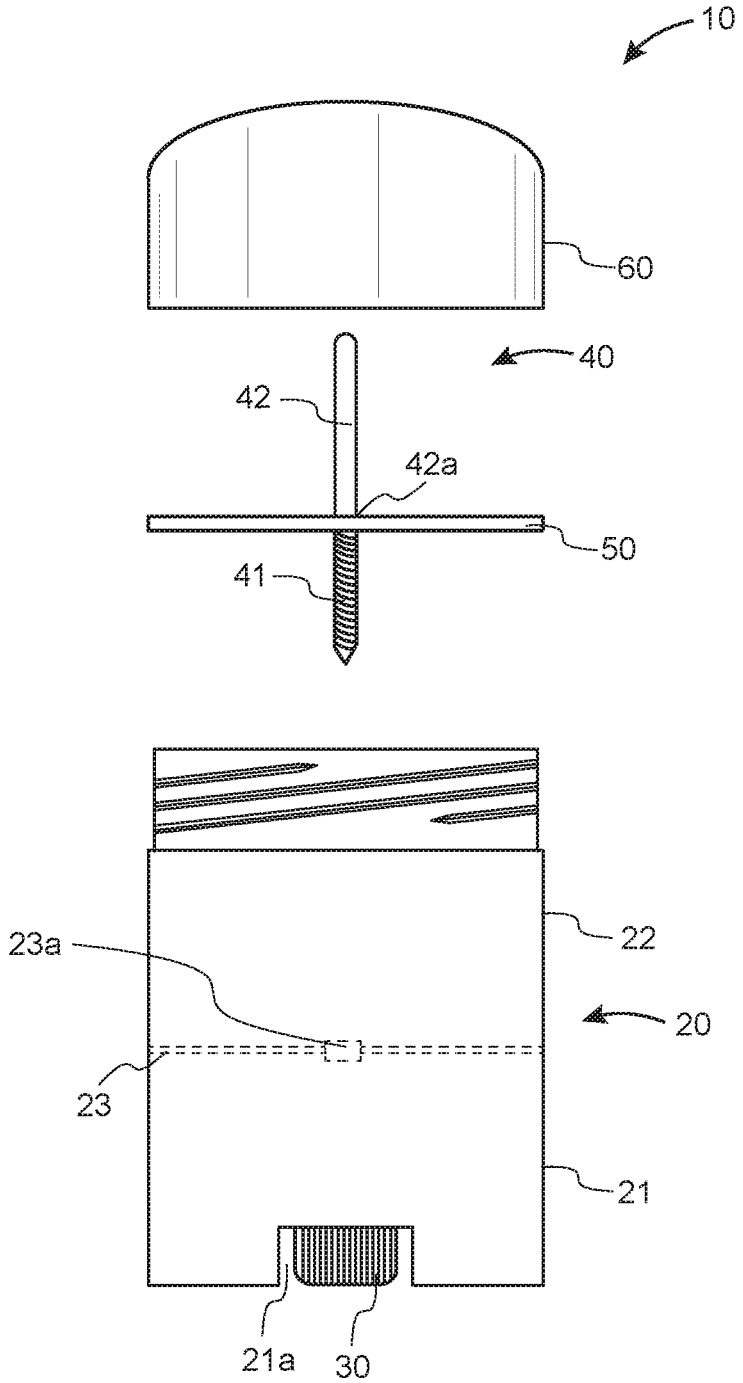
FIG. 3 represents an exploded representation of various components of container 10.
Figure 4:
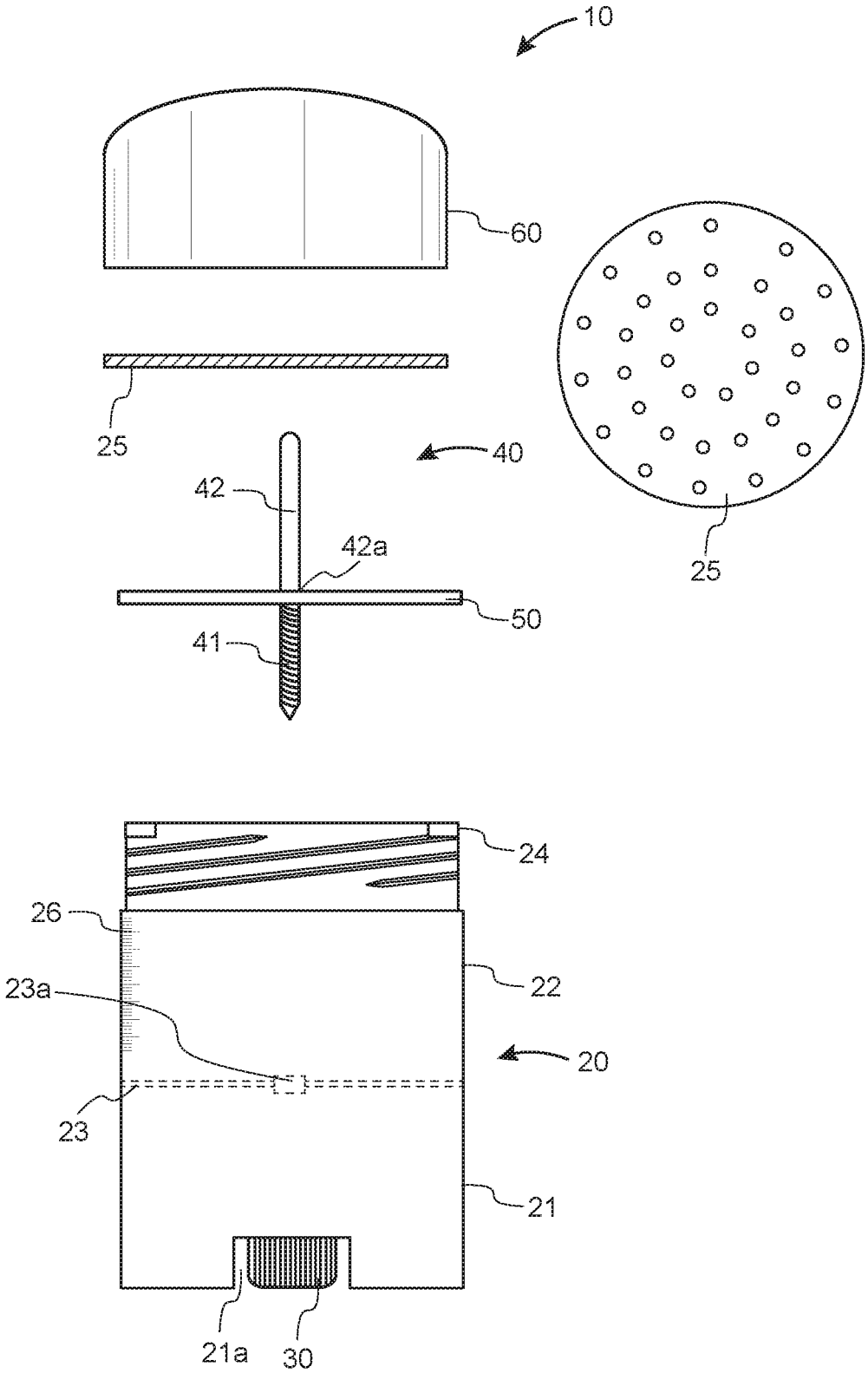
FIG. 4 represents a schematic representation of container 10 depicting a mold 25 and a measuring scale 26.

Referring now to the drawings, FIGS. 1-4, where the present invention is generally referred to with numeral 10, it can be observed that a container, in accordance with one embodiment, is provided for projecting eatables 11 that mainly includes an outer casing 20, a rotatable handle 30, a shaft 40, a movable platform 50 and a cap 60.

Outer casing 20 is defined with a base portion 21 and a housing portion 22. Base portion 21 and housing portion 22 have a partition 23 there between. Partition 23 is defined with a threaded hole 23*a*. Base portion 21 is either integral with housing portion 22 or can be connected with each other to form a single structure. Base portion 21 is defined with a cavity 21*a* at an operative bottom end. Operative bottom end acts as a base for the outer casing 20 to stand on a flat surface, such as a table or a kitchen top or similar other substantially flat surfaces.

Rotatable handle 30 is disposed to be fitted in the cavity 21*a* such that rotatable handle 30 does not protrude out from the operative bottom end of base portion 21. Rotatable handle 30 is accessible by a user to so that user can selectively rotate rotatable handle 30.

Shaft 40 is formed of two parts, namely, a lower part 41 and an upper part 42. Lower part 41 is disposed in base portion 21 and upper part 42 is disposed in housing portion 22. Lower part 41 is engaged with rotatable handle 30 and rotates when rotatable handle 30 is rotated. Lower part 41 is threaded and configured to pass through threaded hole 23*a*.

Movable platform 50 is attached at a lower end 42*a* of upper part 42. When shaft 40 is rotated in a first direction by rotatable handle 30, movable platform 50 raises upwards in housing portion 22 and when shaft 40 is rotated in a second direction, opposite to the first direction, by rotatable handle 30, movable platform 50 is lowered. Movable platform 50 supports eatable 11 and moves eatable upwards to project out of outer casing 20. Once eatable 11 is projected outward, eatable is easy to be access and removed. Once the desired quantity of eatable 11 is removed, if any eatable 11 still remains outside outer casing 20, rotatable handle 30 is rotated in the second direction so that the remaining eatable 11 is moved back inside outer casing 20.

Cap 60 is provided for enclosing outer casing 20. In one embodiment as illustrated in FIGS. 1-4, cap 60 threadably engages with outer casing 20. In another embodiment, cap 60 has a portion pivotally connected with outer casing 20.

In an additional embodiment, outer casing 20 is configured with supports 24 at an operative top of housing portion 22 to support a mold 25, which can be removable of at least one desired shape so that eatable 11 while being removed achieves the desired shape.

In still another additional embodiment, a measuring scale 26 is provided on outer casing 20 and measuring scale 26 have a pre-defined unit so that measured quantity of eatable 11 can be removed. Outer casing 20 is made of a transparent material for enabling eatable 11 and measuring scale 26 from outside.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A container for eatables, said container comprising:

an outer casing defined with a base portion and a housing portion, said base portion defined with a cavity at an operative bottom end, said outer casing having a neck portion with outer threads at an operative top end, wherein said neck portion includes a topmost end being entirely flat, a partition placed between said base portion and said housing portion, wherein said partition includes a threaded hole on a center portion;

a rotatable handle disposed in said cavity;

a shaft defined with a lower part disposed in said base portion and an upper part disposed in said housing portion, said upper part having a smooth outer surface, said lower part being threaded and engaged through said threaded hole and mounted within said rotatable handle to rotate with said rotatable handle, wherein said lower part has a length greater than said upper part;

a movable platform attached at a lower end of said upper part and configured to move in said housing portion upon rotation of said shaft, said movable platform configured to project in and out the eatables; and a cap for enclosing said outer casing.

2. The container as claimed in claim 1, wherein said cap is threadably connected with said outer casing.

3. The container as claimed in claim 1, wherein said cap is defined with a portion that is pivotally connected with outer casing and said cap and said outer casing are press-locked.

4. The container as claimed in claim 1, wherein the eatables are one of peanut butter, cheese, mayonnaise, chocolate jam and jelly.

5. The container as claimed in claim 1, further includes a mold plate for providing a shape to eatables while projecting out of said outer casing.

6. The container as claimed in claim 1, further includes a measuring scale on said housing portion to project out a measured quantity of eatables.

7. The container as claimed in claim 1, wherein said neck portion includes two supports at a topmost end.

8. The container as claimed in claim 7, wherein said two supports support a mold having a circular shape, wherein said mold includes a plurality of circular openings positioned in a circular formation along said mold.

9. The container as claimed in claim 8, wherein said mold is removable from said supports.

10. The container as claimed in claim 1 wherein said lower part of said shaft includes a pointed distal end held within said rotatable handle.

11. The container as claimed in claim 1 wherein said outer casing is made entirely of a transparent material.

12. The container as claimed in claim 1 wherein said shaft extends to a topmost end of said outer casing.

13. The container as claimed in claim 1, wherein said cap includes a circular top end.

14. A container for eatables, said container comprising:

an outer casing made entirely of a transparent material defined with a base portion and a housing portion, said base portion defined with a cavity at an operative bottom end, said outer casing having a neck portion with outer threads at an operative top end, wherein said neck portion includes a topmost end being entirely flat, said neck portion includes two supports at a top most end, wherein said two supports support a mold having a circular shape, said mold having a plurality of openings located thereon, wherein said mold is removable from said two supports, a partition placed between said base portion and said housing portion, wherein said partition includes a threaded hole on a center portion;

a rotatable handle disposed in said cavity;

a shaft defined with a lower part disposed in said base portion and an upper part disposed in said housing portion, said upper part having a smooth outer surface, said lower part being threaded and engaged through said threaded hole and mounted within said rotatable handle to rotate with said rotatable handle, wherein said lower part has a length greater than said upper part, wherein said lower part includes a pointed end that is inserted within said rotatable handle;

a movable platform attached at a lower end of said upper part and configured to move in said housing portion upon rotation of said shaft, said movable platform configured to project in and out the eatables;

a mold plate for providing a shape to eatables while projecting out of said outer casing;

a cap for enclosing said outer casing, wherein said cap threadably connected with said outer casing or said cap defined with a portion that is pivotally connected with outer casing and said cap and said outer casing are press-locked, said cap having a circular top end; and a measuring scale on said housing portion to project out measured quantity of eatables, wherein the eatables are one of butter, cheese, mayonnaise, chocolate jam and jelly.

* * * * *